United States Patent [19]

Muraji et al.

[11] Patent Number: 4,986,240

[45] Date of Patent: Jan. 22, 1991

[54] FUEL INJECTION DEVICE FOR INJECTION CARBURETORS

[75] Inventors: Tetsuo Muraji; Mitsuru Sekiya, both of Odawara, Japan

[73] Assignee: Mikuni Kogyo Kabushiki Kaisha, Tokyo, Japan

[21] Appl. No.: 352,299

[22] Filed: May 16, 1989

[51] Int. Cl.[5] ..... F02M 39/00

[52] U.S. Cl. ..... 123/452; 123/463

[58] Field of Search ..... 123/452, 453, 454, 455, 123/463, 464

[56] References Cited

U.S. PATENT DOCUMENTS

| | | | |
|---|---|---|---|
| 2,432,283 | 12/1947 | Chandler | 123/463 |
| 3,409,276 | 11/1968 | Fuchs | 123/463 |
| 3,494,340 | 2/1970 | Weber | 123/453 |
| 3,826,234 | 7/1974 | Cinquegrani | 123/463 |
| 4,194,478 | 3/1980 | Sumiyoshi | 123/452 |
| 4,228,777 | 10/1980 | Haase | 123/454 |
| 4,334,511 | 6/1982 | Atsumi | 123/454 |

FOREIGN PATENT DOCUMENTS

| | | | |
|---|---|---|---|
| 113297 | 6/1941 | Australia | 123/463 |

*Primary Examiner*—Carl Stuart Miller

*Attorney, Agent, or Firm*—Lalos & Keegan

[57] ABSTRACT

The fuel injection device for injection carburetors comprises a slow fuel control unit consisting of an air pressure regulator and a fuel pressure regulator, and a main fuel control unit consisting of another air pressure regulator and another fuel pressure regulator. The slow fuel control unit and the main fuel control unit have a common fuel feeding passage, and the former fuel control unit is arranged at a location downstream the latter fuel control unit. This feel injection device has a broad control range and high control accuracy, is manufacturable at a low cost and is capable of maintaining initial performance thereof for a long term.

10 Claims, 2 Drawing Sheets

FUEL INJECTION DEVICE FOR INJECTION CARBURETORS

BACKGROUND OF THE INVENTION (a) Field of the Invention:

The present invention relates to a fuel injection device for injection carburetors capable of accurately controlling fuel injection rates adequately on the basis of negative pressures produced in accordance with flow rates of air to be sucked.

(b) Description of the prior art:

As an example of the conventional fuel injection devices of this type, there is known the Bendix-Stromberg fuel injection system for aircrafts (see "Spark-Ignition Engines: Fuel Injection Systems", CHARLES H. FISHER, CHARLES & HALL, 1966. The structure and functions of this fuel injection system will be briefly described below. The fuel injection system comprises a fuel control unit consisting of an air pressure regulator divided by an air diaphragm into an atmosphere chamber into which impact pressures are to be introduced and a depression chamber into which venturi pressures are to be introduced; a fuel pressure regulator divided by a fuel diaphragm into a fuel pressure chamber into which a fuel is fed by a fuel pump and a fuel injection chamber communicated with the fuel pressure chamber through a metering jet; a connecting member which is connected to the air diaphragm and the fuel diaphragm, and has a poppet valve for opening and closing a fuel inlet to the fuel pressure chamber; and a fuel nozzle which is connected to the fuel injection chamber and functions to eject the fuel into a suction tube at a location downstream a throttle valve. When a flow rate of air to be sucked through the throttle valve is set in this fuel control unit after the engine is started, a differential pressure corresponding to the air flow rate is produced between the atmosphere chamber and the depression chamber of the air pressure regulator, and the air diaphragm displaces the connecting member toward the depression chamber so as to open the poppet valve widely. On the other hand, the differential pressure between the fuel pressure chamber and the fuel injection chamber is applied to the fuel diaphragm, which displaces the connecting member in the reverse direction so as to close the poppet valve. At a position where these two differential pressures acting in the reverse directions are balanced with each other, opening degree of the poppet valve is determined, whereby flow rate of the fuel to be introduced into the fuel pressure chamber is determined. Since the fuel nozzle discharges the fuel at a constant pressure, the fuel pressure downstream the metering jet is set at a predetermined level proportional to the nozzle pressure. Accordingly, there is produced between the upstream side and the downstream side of the metering jet a differential pressure which is equal to the differential pressure produced between the atmosphere chamber and the depression chamber of the air pressure regulator. Since both the air flow rate and the fuel flow rate are proportional to the root of the above-mentioned differential pressure, the flow rate of the fuel to be ejected into the suction tube is proportional to the flow rate of air to be sucked and air-fuel ratio is kept constant.

However, this fuel injection device is practically capable of controlling flow rate of air to be sucked and flow rate of the fuel to be ejected only within a range of 8 to 10 times of the minimum flow rates thereof. When the negative pressure produced in the venturi by the air flow rate for the maximum output is assumed to be approximately 30 mmHg, for example, the negative pressure produced by the minimum controllable air flow rate is 0.3 mmHg (4.1 mmAq) and the fuel injection device is incapable of controlling air flow rates lower than 0.3 mmHg. On the other hand, the usual engines for automobiles must have a capability to control air flow rates and fuel flow rates within a range of about 60 times of the minimum flow rates. Therefore, the fuel injection system described above cannot be used as a fuel injection device for automobiles.

SUMMARY OF THE INVENTION

A primary object of the present invention is to provide a fuel injection device of the above-described type having a broad control range applicable to automobiles or motorcycles.

Another object of the present invention is to provide a mechanical fuel injection device capable of maintaining high control accuracy and accurately adjusting air-fuel ratio of the mixture to be supplied to an engine.

A third object of the present invention is to provide a mechanical fuel injection device manufacturable at a low cost and capable of maintaining initial performance thereof for a long term.

According to the present invention, these objects are accomplished by combining a slow fuel control unit capable of ejecting a fuel at low rates in accordance with relatively low flow rates of air to be sucked with a main fuel control unit capable of ejecting the fuel at high rates in accordance with relatively high flow rates of air to be sucked.

According to the present invention, negative pressures produced in accordance with low air flow rates in the slow driving range are introduced into the slow fuel control unit to eject the fuel at the rates corresponding to the levels of the negative pressures, whereas negative pressures produced in accordance with high air flow rates in the main driving range are introduced into the main fuel control unit to eject the fuel at the rates corresponding to the negative pressures. In the main driving range, the fuel is ejected in metered quantities from both the main fuel control unit and the slow fuel control unit.

In a preferred formation of the present invention, a slow fuel metering member for metering flow rates of the fuel ejected from the slow fuel control unit is arranged at a location downstream a main fuel metering member for metering flow rates of the fuel ejected from the main fuel control unit. Since the fuel ejected in the slow driving range is metered by the main fuel metering member and then metered once again by the slow fuel metering member, the fuel injection device is capable of metering the fuel with very high accuracy and producing the mixture more adequately over the entire slow driving range.

In another preferred formation of the present invention, each of the main fuel metering member and the slow fuel metering member is equipped with a fuel feeding rate adjusting means which is capable of bypassing said fuel metering member for adjusting additional fuel. These means enhances the flexibility in the fuel ejecting rate setting and enables to adjust the fuel ejection rates more accurately.

These and other objects as well as the features and advantages of the present invention will become apparent from the detailed description of the preferred embodiments when taken in conjunction with the accompanying drawings.

DETAILED DESCRIPTION OF THE PREFERRED EMBODIMENTS

Figure 1:
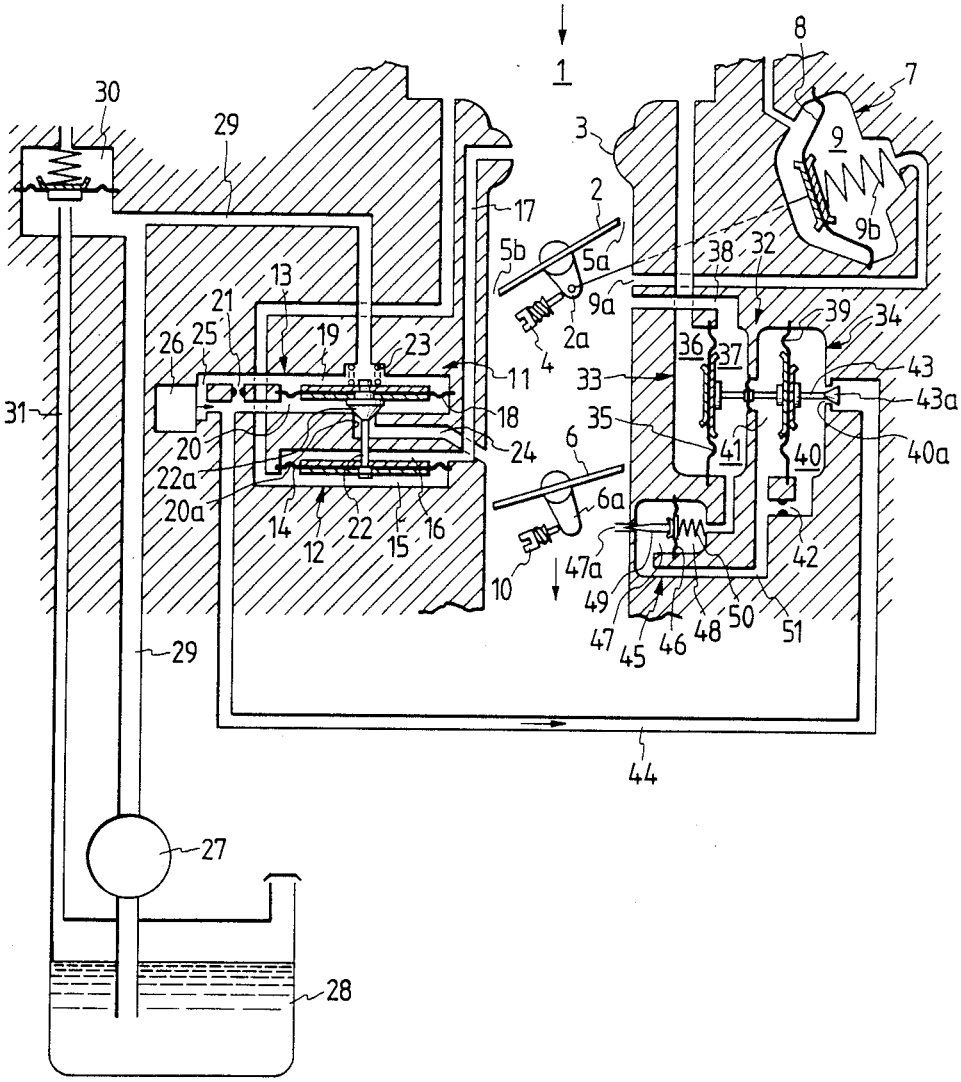
FIG. 1 is a schematic sectional view illustrating Embodiment 1 of the fuel injection device for injection carburetors according to the present invention.

Now, the Embodiment 1 of the present invention will be described below with reference to FIG. 1. In the drawing, the reference numeral 1 represents a suction tube, i.e., a suction bore of a carburetor, the reference numeral 2 designates a disk-like air valve openably arranged at a location downstream a venturi 3 and the reference numeral 4 denotes a stopper which is engaged with a lever 2*a* fixedly attached to the rotating shaft of the air valve 2 for preventing the suction tube 1 from being completely closed by the air valve 2 and adapted to leave narrow gaps 5*a* and 5*b* between the outer circumference of the air valve 2 and the inside wall of the suction tube 1 in the condition of the minimum opening degree (initial opening degree) where the lever 2*a* is engaged with the stopper 4 (the condition illustrated in FIG. 1). The reference numeral 6 represents a throttle valve arranged at a location downstream the air valve 2. The reference numeral 7 designates a negative pressure actuator comprising a diaphragm 8 connected to the lever 2*a* of the air valve 2 for controlling opening degree of the air valve 2. The reference numeral 9 denotes a depression chamber separated by the diaphragm 8 and communicated with the suction tube 1 through an opening 9*a* located downstream the gap 5*a*. The diaphragm 8 is adapted to be kept at the position shown in FIG. 1 under a biasing force applied by a spring 9*b* while the engine is rested, but is displaced toward the depression chamber 9 against the resilience of the spring 9*b* to open the air valve 2 when a negative pressure produced in the opening 9*a* exceeds a predetermined value after the engine is started. Speaking concretely of the practical operation, the negative pressure actuator 7 does not operate and functions to keep the air valve 2 at the initial opening degree in the slow driving range. The reference numeral 10 represents a stopper which is engaged with a throttle lever 6*a* fixedly attached to the rotating shaft of the throttle valve 6 for maintaining the throttle valve 6 at the minimum opening degree.

The reference numeral 11 represents a main fuel control unit equipped with an air pressure regulator 12 and a fuel section of regulator 13, the reference numeral 14 designates a diaphragm dividing the air pressure regulator 12 into an atmosphere chamber 15 and a depression chamber 16, and the reference numeral 17 denotes a main negative pressure passage having an end communicated with the depression chamber 16 and the other end open to the venturi 3 in the suction tube 1. The reference numeral 18 represents a diaphragm dividing the fuel pressure regulator 13 into a fuel pressure chamber 19 and a fuel injection chamber 20, the reference numeral 21 represents a main jet designed as a fuel metering member communicating the fuel pressure chamber 19 with the fuel injection chamber 20, the reference numeral 22 designates a connecting member for connecting the diaphragm 14 to the diaphragm 18 and equipped with a fuel injection valve 22*a* capable of opening and closing a fuel injection port 20*a*, the reference numeral 23 denotes a spring arranged in the fuel pressure chamber 19 for biasing the diaphragm 18 downward, and the reference numeral 24 represents a main fuel injection passage having an end communicated with the fuel injection port 20*a* and the other end communicated with the suction tube 1 at a location between the air valve 2 and the throttle valve 6. The reference numeral 25 represents a main bypass passage which bypasses the main jet 21 for communicating the fuel pressure chamber 19 with the fuel injection chamber 20, and the reference numeral 26 designates a solenoid valve arranged in the course of the main bypass passage 26 for controlling fuel flow rate separately from the main jet 21. This solenoid valve 26 is subjected to duty control by a control circuit (not shown) and adjusts fuel flow rate for controlling air-fuel ratio of the mixture in the main driving range. The reference numeral 27 represents a fuel pump for feeding the fuel from a fuel tank 28 into the fuel pressure chamber 19 through a fuel feeding passage 29 and the reference numeral 30 designates a fuel pressure adjusting chamber communicated with the fuel feeding passage 29. This fuel pressure adjusting chamber 30 adjusts the fuel pressure in the fuel feeding passage 29 for controlling flow rate of the fuel to be fed into the fuel pressure chamber 19 through the fuel feeding passage 29 and serves also to return excessive fuel into the fuel tank 28 through a return passage 31.

The reference numeral 32 represents a slow fuel control unit equipped with an air pressure regulator 33 and a fuel section of regulator 34, the reference numeral 35 designates a diaphragm dividing the air pressure regulator 33 into an atmosphere chamber 36 and a depression chamber 37, the reference numeral 38 denotes a subsidiary negative pressure passage having an end communicated with the depression chamber 37 and the other end open to the suction tube 1 at a location downstream the gap 5*a* of the air valve 2, the reference numeral 39 denotes a diaphragm dividing the fuel pressure regulator 34 into a fuel pressure chamber 40 and a fuel injection chamber 41, and the reference numeral 42 represents a pilot jet for communicating the fuel pressure chamber with the fuel injection chamber 41, the pilot jet 42 being designed as a fuel metering member for metering the fuel to be ejected in the slow driving range. The reference numeral 43 represents a connecting member which is connected commonly to the diaphragm 35, the diaphragm 35 separating the depression chamber 37 from the fuel injection chamber 41 and the diaphragm 39, and equipped at the tip thereof with a fuel feeding valve 43*a*. This valve 43*a* is adapted to move in a fuel inlet 40*a* to the fuel pressure chamber 40 for controlling fuel feeding rate into the fuel pressure chamber 40 and to maintain the fuel inlet 40*a* at the minimum opening degree thereof while the engine is rested. The reference numeral 44 represents a fuel passage having an end communicated with the fuel injection chamber of the main fuel control unit 11 and the other end communicated with the fuel inlet 40*a* of the fuel pressure chamber 40 of the slow fuel control unit 32. The reference numeral 45 represents a slow fuel injection valve comprising a nozzle chamber 47 and a depression chamber 48 separated from each other by a diaphragm 46, said nozzle chamber being equipped with a fuel nozzle 47*a* and said depression chamber being communicated with the depression chamber 37, a needle valve 49 attached fixedly to the diaphragm 46 and capable of opening and closing the fuel nozzle 47*a*, and a spring 50 for biasing the needle valve 49 by way of the diaphragm 46 so as to close the fuel nozzle 47*a*. The reference numeral 51 represents a slow fuel passage for communicating the fuel injection chamber 41 with the nozzle chamber 47. The fuel nozzle 47*a* is open to the suction tube 1 at a location downstream the throttle valve 6 and is closed by the needle valve 49 while the engine is rested.

Now, the function of the Embodiment 1 of the present invention will be explained below.

First, the air valve 2 is set at the initial opening degree illustrated in FIG. 1 in the slow driving range just after the engine is started and, when the throttle valve 6 is opened a little, air flows through the gaps 5*a* and 5*b* of the air valve 2, thereby producing a negative pressure at the location downstream said gaps. This negative pressure is at a level too low to operate the negative pressure actuator 7 and the air valve 2 is kept at the initial opening degree. On the other hand, this negative pressure is introduced through the subsidiary negative pressure passage 38 into the depression chamber 37 of the slow fuel control unit 32 and the depression chamber 48 of the slow fuel injection valve 45. Accordingly, both the diaphragms 35 and 46 are displaced rightward, whereby the diaphragm 39 is also displaced rightward and the needle valve 49 opens the fuel nozzle 47*a*. Since a pressure loss is produced downstream the pilot jet 42 when the diaphragm 39 is displaced rightward as described above, the fuel pressure drops in the fuel injection chamber 41 and the opening degree of the fuel inlet 40*a* is increased to enhance the fuel pressure in the fuel pressure chamber 40. Accordingly, a leftward biasing force is applied to the diaphragm 39 upon the rightward displacement thereof and, as a result, the diaphragm 39 is displaced rightward until these two biasing forces are balanced with each other. Therefore, opening degree of the fuel inlet 40*a* is determined in accordance with the negative pressure introduced into the depression chamber 37 and the fuel is fed into the fuel pressure chamber 40 in a quantity proportional to the level of the negative pressure introduced into the depression chamber 37. As a result, the fuel is metered by the pilot jet 42 in a quantity proportional to the level of the negative pressure, and then is fed from the fuel pressure chamber 40 into the fuel injection chamber 41, further through the slow fuel passages 51 into the nozzle chamber 47 and ejected through the fuel nozzle 47*a* into the air flowing through the suction tube 1. As flow rate of air passing through the gaps 5*a* and 5*b* is enhanced as described above, the diaphragms 35 and 39 as well as the connecting member 43 are displaced further rightward, the slow injection valve 45 allows the fuel to be ejected at a higher rate, and fuel feeding rate from the fuel pressure chamber 40 through the pilot jet 42 into the fuel injection chamber 41 and fuel inflow rate through the fuel inlet 40*a* into the fuel pressure chamber 41 are enhanced. On the other hand, the main fuel control unit 11 does not operate since the pressure in the venturi 3 to be introduced through the main negative pressure passage 17 into the depression chamber 16 is substantially equal to the pressure in the atmosphere chamber 15, and the main fuel injection valve 22*a* keeps the fuel passage 24 in the closed condition. Accordingly, the fuel is fed into the fuel pressure chamber 19 of the main fuel control unit 11 in a quantity matched with the injection rate through the slow fuel injection valve 45, metered by the main jet 21 and then fed through the fuel passage 44 into the fuel inlet 40*a* of the slow fuel control unit 32. As a result, the fuel is further metered and ejected, in the slow driving range, by the pilot jet 42 in quantities within the minimum fuel flow rate range which can be metered by the main jet 21.

When the throttle valve 6 is further opened in the condition described above, flow rate of the air passing through the gaps 5*a* and 5*b* is enhanced. When the negative pressure introduced through the opening 9*a* into the depression chamber 9 of the negative pressure actuator 7 exceeds a predetermined level, the negative pressure actuator starts its operation and the air valve 2 is turned counterclockwise from the position of the initial opening degree. Accordingly, a negative pressure is produced at the venturi in the suction tube 1, and the negative pressure is introduced through the main negative pressure passage 17 into the depression chamber 16 of the main fuel control unit 11, thereby displacing the diagram 14 upward against the biasing force of the spring 23. Accordingly, the connecting member 22 is displaced upward to make the fuel injection valve 22*a* apart from the fuel injection port 20*a*, thereby allowing the fuel in the fuel injection chamber 20 to be ejected into the suction tube 1 through the main fuel injection passage 24, and the diaphragm 18 is also displaced upward simultaneously. Since the diaphragm 18 is displaced upward as described above and the pressurized fuel is fed into the fuel pressure chamber 19, the fuel is introduced while being metered, through the main jet 21 from the fuel pressure chamber 19 into the fuel injection chamber 20. Due to the differential fuel pressure enhanced between the fuel pressure chamber 19 and the fuel injection chamber 20, a force is applied in the direction to close the fuel injection port 20*a*, and the fuel injection valve 22*a* is stopped in a condition where the load applied to the diaphragm 14 is balanced with the load applied to the diaphragm 18. Opening degree of the fuel injection port 20*a* is varied depending on increase and decrease of the negative pressure, and fuel injection rate is enhanced and lowered accordingly. Further, the fuel is fed into the fuel injection chamber 20 in a quantity which is equal to the total sum of the quantity metered by the main jet 21 and the quantity fed by the operation of the solenoid valve 26 through the bypass passage 25 in accordance with the air-fuel ratio of the mixture demanded depending on driving condition of the engine, however, a certain portion of the total quantity is fed also to the slow fuel control unit 32.

As is understood from the foregoing description, the Embodiment 1 of the present invention is adapted to eject the fuel at low rates by the slow fuel control unit 32 in accordance with low air flow rates in the slow driving range and at high rates by the main fuel control unit 11 in accordance with high air flow rates in the main driving range. Even when the ratios between the maximum values and the minimum values of air flow rate and fuel injection rate controllable by the fuel control units 11 and 32 are about 8x respectively, the fuel injection device as a whole can provide a control ratio on the order of 64x and is sufficiently usable as a fuel injection device for automobiles or motorcycles. Further, since the fuel to be ejected from the slow fuel control unit 32 is metered by main jet 21 and fed through the fuel passage 44, the fuel is a portion of the fuel metered by the main jet 21 in the main driving range and gives no influence on the metering accuracy in the main driving range.

Figure 2:
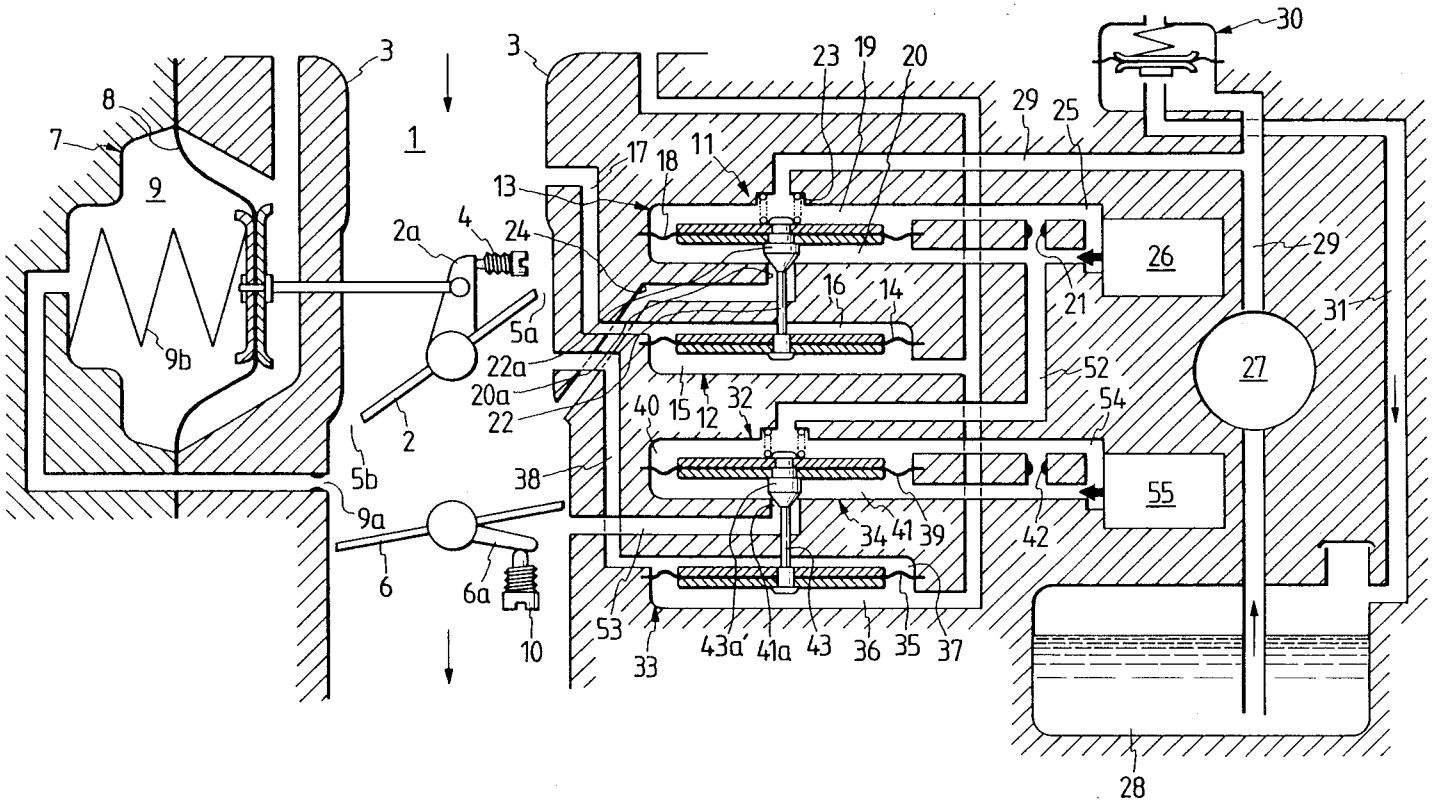
FIG. 2 is a schematic sectional view illustrating Embodiment 2 of the fuel injection device for injection carburetors according to the present invention.

FIG. 2 illustrates the Embodiment 2 of the fuel injection device according to the present invention. The Embodiment 2 will be described below with reference to FIG. 2 wherein the members used in the Embodiment 1 are represented by the same reference numerals and no particular description will not made on these members. In FIG. 2, the reference numeral 52 represents a slow fuel passage for leading the fuel to be fed to the fuel injection chamber 20 of the main fuel control unit 11 into the fuel pressure chamber 40 of the slow fuel control unit 32, and the reference numeral 53 designates a slow fuel injection passage having an end open to the fuel injection port 41*a* in the slow fuel control unit 32 and the other end open to the suction tube 1 at a location downstream the throttle valve 6. The fuel injection port 41*a* and the fuel injection valve 43*a'* are set at the same relationship as that between the fuel injection port 20*a* and the fuel injection valve 22*a* in the main fuel control unit 11. The reference numeral 54 represents a slow bypass passage for communicating the fuel pressure chamber 40 with the fuel injection chamber 41 by bypassing the pilot jet 42 and the reference numeral 55 designates a slow air-fuel ratio control solenoid valve arranged in the course of the slow bypass passage 54 and having the same structure as that of the main air-fuel ratio control valve 26.

Now, functions of the Embodiment 2 will be explained below. In the slow driving range, a negative pressure produced in the opening of the subsidiary negative pressure passage 38 by the air flowing through the gaps 5*a* and 5*b* formed by the air valve 2 is introduced into the depression chamber 37 of the slow fuel control unit 32, and the diaphragms 35 and 39 are displaced upward together with the connecting member 43, whereby the fuel injection port 41*a* is opened and fuel is ejected from the fuel injection chamber 41 into the suction tube 1 through the slow fuel injection passage 53 in a quantity corresponding to the level of the negative pressure on the same operating principle as that described with reference to the main fuel control unit 11 illustrated in FIG. 1. As the negative pressure is enhanced downstream the air valve 2, opening degree of the fuel injection port 41*a* is increased to enhance to fuel injection rate. The fuel is fed into the fuel injection chamber 41 in a quantity equal to the total sum of the quantity of the fuel metered by the pilot jet 42 and the quantity of fuel fed through the bypass passage 54 by the operation of the solenoid valve 55 in accordance with the air-fuel ratio of the mixture demanded depending on driving condition of the engine. Since the main bypass passage 25 is closed by the solenoid valve 26 in this stage, the fuel is fed into the fuel pressure chamber 40 only through the main jet 21.

In the main driving range, the fuel injection port 20*a* in the main fuel control unit 11 is opened by the negative pressure introduced through the main negative pressure passage 17 as described above and the fuel is ejected into the suction tube 1 through the main fuel injection passage 24 in a quantity corresponding to the level of the negative pressure produced in the venturi 3. The fuel is fed into the fuel injection chamber 20 in a quantity equal to the total sum of the quantity of the fuel metered by the main jet 21 and the quantity of the fuel fed through the bypass passage 25 by the operation of the solenoid valve 26 in accordance with the air-fuel ratio of the mixture demanded depending on driving condition of the engine, however a certain portion of the total quantity is supplied also to the slow fuel control unit 32.

As is understood from the foregoing description, the Embodiments 1 and 2 of the present invention are capable of accurately controlling air-fuel ratio of the mixture to be fed to the engine both in the slow and main driving ranges.

In addition, a piston valve or the similar member can be used, needless to say, in place of the disk-like air valve 2 employed in the Embodiments.

What is claimed is:

1. A fuel injection device for injection carburetors comprising a slow fuel control unit for ejecting fuel at relatively low rates into a suction tube in accordance with relatively low flow rates of air to be sucked into said suction tube, and a main fuel control unit for ejecting the fuel at relatively high rates into said suction tube in accordance with relatively high flow rates of air to be sucked into said suction tube, each of said slow fuel control unit and said main fuel control unit comprising an air pressure regulator and a fuel pressure regulator adjacent to said air pressure regulator, said fuel pressure regulator of said slow fuel control unit and said fuel pressure regulator of said main fuel control unit have a common fuel passage, and said fuel pressure regulator of said slow fuel control unit being arranged at the downstream side of said fuel pressure regulator of said main fuel control unit on said common fuel passage.

2. A fuel injection device for injection carburetors according to claim 1 wherein a slow fuel metering member arranged in the fuel pressure regulator of said slow fuel control unit for metering quantity of the fuel to be ejected is located downstream a main fuel metering member arranged in the fuel pressure regulator of said main fuel control unit for metering quantity of the fuel to be ejected.

3. A fuel injection device for injection carburetors according to claim 2 wherein said fuel pressure regulator of the slow fuel control unit has a slow bypass fuel passage bypassing said slow fuel metering member, said fuel pressure regulator of the main fuel control unit has a main bypass fuel passage bypassing said main fuel metering member, and a fuel feeding rate control means for controlling air-fuel ratio of the mixture is arranged in each of said slow bypass fuel passage and said main bypass fuel passage.

4. A fuel injection device for injection carburetors according to claim 2 wherein a fuel injection valve is arranged in a fuel injection port of said slow fuel control unit for discharging the fuel when pressure downstream said slow fuel metering member exceeds a predetermined pressure level.

5. A fuel injection device for injection carburetors according to claim 4 wherein said fuel injection valve comprises a nozzle chamber and a depression chamber separated from each other by a diaphragm, said depression chamber being as designed as to receive negative pressures produced under the relatively low flow rates of air to be sucked, and a needle valve member fixedly attached to said diaphragm and cooperating with said fuel injection port.

6. A fuel injection device for injection carburetors according to any one of claims 1 through 3 wherein a fuel pump and a fuel pressure adjusting chamber are connected to a fuel feeding passage communicated with a fuel inlet to said fuel pressure regulator of the main fuel control unit.

7. A fuel injection device for injection carburetors according to claim 6 further comprising a bypass fuel passage bypassing said main jet and an electromagnetic valve capable of opening and closing said bypass fuel passage.

8. A fuel injection device for injection carburetors according to any one of claims 1 through 3 wherein said slow fuel control unit comprises a first atmosphere chamber and a first depression chamber separated from each other by a first diaphragm, said first depression chamber being communicated with said suction tube at a location downstream an air valve capable of being opened and closed by a negative pressure actuator operated by negative pressures downstream said air valve, a first fuel pressure chamber and a first fuel injection chamber separated from each other by a second diaphragm, a connecting member connected to said first and second diaphragms and equipped with a fuel feeding valve capable of controlling opening degree of a fuel inlet to said first fuel pressure chamber, a pilot jet arranged between said first fuel pressure chamber and a first fuel injection chamber, and a normally closed fuel injection valve arranged downstream said pilot jet and opened by negative pressures introduced into said first depression chamber; and said main fuel control unit comprises a second atmosphere chamber and a second depression chamber separated from each other by a third diaphragm, said second depression chamber being communicated with a venturi in said suction tube, a second fuel pressure chamber and a second fuel injection chamber separated from each other by a fourth diaphragm, a connecting member connected to said third and fourth diaphragms and equipped with a normally closed fuel injection valve capable of controlling opening degree of a fuel injection port of said second fuel injection chamber, and a main jet arranged between said second fuel pressure chamber and said second fuel injection chamber.

9. A fuel injection device for injection carburetors according to any one of claims 1 through 3 wherein said slow fuel control unit comprises a first atmosphere chamber and a first depression chamber separated from each other by a first diaphragm, said first depression chamber being communicated with said suction tube at a location downstream an air valve capable of being opened and closed by a negative pressure actuator operated by negative pressures downstream said air valve, a first fuel pressure chamber and a first fuel injection chamber separated from each other by a second diaphragm, a connecting member connected to said first and second diaphragms and equipped with a normally closed fuel injection valve capable of controlling opening degree of a fuel injection port of said first fuel injection chamber, and a pilot jet arranged between said first fuel pressure chamber and said first fuel injection chamber; and said main fuel control unit comprises a second atmosphere chamber and a second depression chamber separated from each other by a third diaphragm, said second depression chamber being communicated with a venturi in said suction tube, a second fuel pressure chamber and a second fuel injection chamber separated from each other by a fourth diaphragm, a connecting member connected to said third and fourth diaphragms and equipped with a normally closed fuel injection valve capable of controlling opening degree of a fuel injection port of said second fuel injection chamber, and a main jet arranged between said second fuel pressure chamber and said second fuel injection chamber.

10. A fuel injection device for injection carburetors according to claim 9 further comprising a first bypass fuel passage bypassing said pilot jet, an electromagnetic valve capable of opening and closing said first bypass fuel passage, a second bypass fuel passage bypassing said main jet, and an electromagnetic valve capable of opening and closing said second bypass fuel passage.

* * * * *

UNITED STATES PATENT AND TRADEMARK OFFICE

CERTIFICATE OF CORRECTION

PATENT NO. : 4,986,240

DATED : January 22, 1991

INVENTOR(S) : Tetsuo Muraji and Sekiya Mitsuru

It is certified that error appears in the above-identified patent and that said Letters Patent is hereby corrected as shown below:

column 3, line 54, delete "section of" and insert --pressure--.

column 4, line 33, delete "section of" and insert --pressure--.

column 6, line 19, delete "diagram" and insert --diaphragm--.

column 8:
claim 5, line 58, delete both occurrences of "as".

Signed and Sealed this

Eighth Day of September, 1992

*Attest:*

*Attesting Officer*

DOUGLAS B. COMER

*Acting Commissioner of Patents and Trademarks*